US007762842B2

(12) United States Patent
Deubel et al.

(10) Patent No.: US 7,762,842 B2
(45) Date of Patent: Jul. 27, 2010

(54) GROMMET FOR ELECTRICAL CONNECTOR, AND ELECTRICAL CONNECTOR COMPRISING SUCH A GROMMET

(75) Inventors: Sébastien Deubel, Longvilliers (FR); Christian Campfort, Fresnay le Gilmert (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/918,265

(22) PCT Filed: Apr. 11, 2006

(86) PCT No.: PCT/EP2006/003320

§ 371 (c)(1),
(2), (4) Date: Jan. 12, 2009

(87) PCT Pub. No.: WO2006/108609

PCT Pub. Date: Oct. 19, 2006

(65) Prior Publication Data

US 2009/0215312 A1 Aug. 27, 2009

(30) Foreign Application Priority Data

Apr. 11, 2005 (WO) ..... PCT/EP2005/005203

(51) Int. Cl.
*H01R 13/40* (2006.01)

(52) U.S. Cl. ..... 439/589

(58) Field of Classification Search ..... 439/589, 439/587, 274
See application file for complete search history.

(56) References Cited

U.S. PATENT DOCUMENTS 4,648,672 A 3/1987 Kobler ..... 339/94 M (Continued)

*Primary Examiner*—T C Patel
*Assistant Examiner*—Vladimir Imas
(74) *Attorney, Agent, or Firm*—Harrington & Smith

(57) ABSTRACT

This grommet joint includes a peripheral portion provided to sealingly engage a peripheral inner surface of a connector housing, and a central portion having at least one through passage for a wire. Recesses are provided between the central portion and the peripheral portion, the central portion being attached to the peripheral portion by flexible walls, whereby the central portion is rotatory attached to the peripheral portion.

15 Claims, 7 Drawing Sheets

U.S. PATENT DOCUMENTS

| | | | | | |
|---|---|---|---|---|---|
| 4,690,478 | A | * | 9/1987 | Rahrig et al. | 439/271 |
| 4,697,861 | A | * | 10/1987 | Mitchell | 439/271 |
| 4,713,021 | A | * | 12/1987 | Kobler | 439/272 |
| 4,973,266 | A | * | 11/1990 | Bullard | 439/589 |
| 5,076,806 | A | * | 12/1991 | Hotea et al. | 439/595 |
| 5,299,949 | A | * | 4/1994 | Fortin | 439/275 |
| 5,562,494 | A | * | 10/1996 | Fujiwara | 439/587 |
| 5,618,198 | A | * | 4/1997 | Sato et al. | 439/274 |
| 5,634,807 | A | * | 6/1997 | Saito | 439/275 |
| 5,667,406 | A | * | 9/1997 | Tabata et al. | 439/587 |
| 5,676,373 | A | | 10/1997 | Sakai et al. | 277/205 |
| 5,871,373 | A | * | 2/1999 | Pacini et al. | 439/587 |
| 6,053,754 | A | * | 4/2000 | Kano et al. | 439/281 |
| 6,095,860 | A | * | 8/2000 | Gehrke et al. | 439/587 |
| 6,114,629 | A | * | 9/2000 | Roush et al. | 174/650 |
| 6,176,739 | B1 | | 1/2001 | Denlinger et al. | 439/589 |
| 6,183,296 | B1 | * | 2/2001 | Pacini et al. | 439/577 |
| 6,375,500 | B1 | * | 4/2002 | Murakami et al. | 439/587 |
| 6,383,022 | B1 | * | 5/2002 | Murakami et al. | 439/589 |
| 6,616,480 | B2 | * | 9/2003 | Kameyama | 439/587 |
| 6,685,496 | B2 | * | 2/2004 | Ookura | 439/372 |
| 6,787,701 | B2 | * | 9/2004 | Yasuda et al. | 174/664 |
| 6,814,632 | B1 | * | 11/2004 | Peterson | 439/877 |
| 6,986,677 | B2 | * | 1/2006 | Janssen | 439/275 |
| 7,114,991 | B2 | * | 10/2006 | Shiga et al. | 439/587 |
| 7,115,822 | B1 | * | 10/2006 | Day et al. | 174/662 |
| 7,156,697 | B2 | * | 1/2007 | Drescher | 439/587 |
| 7,264,506 | B2 | * | 9/2007 | Mori et al. | 439/606 |
| 7,273,395 | B2 | * | 9/2007 | Hayashi | 439/587 |
| 7,338,319 | B2 | * | 3/2008 | Casses et al. | 439/587 |
| 7,371,115 | B1 | * | 5/2008 | Hsieh et al. | 439/587 |

* cited by examiner

GROMMET FOR ELECTRICAL CONNECTOR, AND ELECTRICAL CONNECTOR COMPRISING SUCH A GROMMET

BACKGROUND OF THE INVENTION

The invention relates to grommet-type joints for electrical connectors, and to electrical connectors which are sealed by means of such joints.

Grommet-type joints commonly used in the art are integrally made of an elastomeric material. They are arranged in dedicated rear skirts of connector housings and eventually held in place by a grid, which bears on the grommet rear side and which is releasably fastenable to the housing.

More specifically, the invention relates to grommets comprising a peripheral portion having a peripheral outer surface provided to sealingly engage a peripheral inner surface of a connector housing, and a central portion having at least one through passage for a wire, said passage extending in an axial direction.

In the connector assembling process, the terminals are inserted through the grommet passages in respective chambers provided in the insulating housing.

In conventional grommets, the central portion is continuously formed with the peripheral portion and/or attached to the peripheral portion at its corners. When the grommet is outwards restrained by the housing at the peripheral portion, the central portion can only expand by radial compression of the elastomeric material upon insertion of the terminals.

Said compression deformability is low, whereby the insertion force to be applied to the terminals and cable is relatively high.

In addition, the low deformability of the grommet passages makes it difficult to use the same grommet for different cable diameters with a high sealing efficiency.

Moreover, because of damage caused by the high insertion force between terminal and grommet, the sealing efficiency of such a grommet highly decreases after several insertion/withdrawal operations.

SUMMARY OF THE INVENTION

It is an object of the invention to provide an improved joint for electrical connector of the above-defined type.

Accordingly, the invention provides a grommet-type joint of the above-defined type, wherein recesses are provided between said central portion and said peripheral portion, said central portion being attached to said peripheral portion by flexible means. By this way the central portion is rotatory attached to the peripheral portion.

The flexible means connecting the central portion to the peripheral portion act as articulations, such that the passages of the central part can come into a better alignment with the insertion axis and thus reduce the insertion force.

The recesses also reduce the insertion force by facilitating the expansion of the elastomeric material upon insertion.

BRIEF DESCRIPTION OF THE DRAWINGS

FIG. 1' is a front view of the grommet alone corresponding to FIG. 1;

DETAILED DESCRIPTION OF ONE PREFERRED EMBODIMENT

Figure 1:
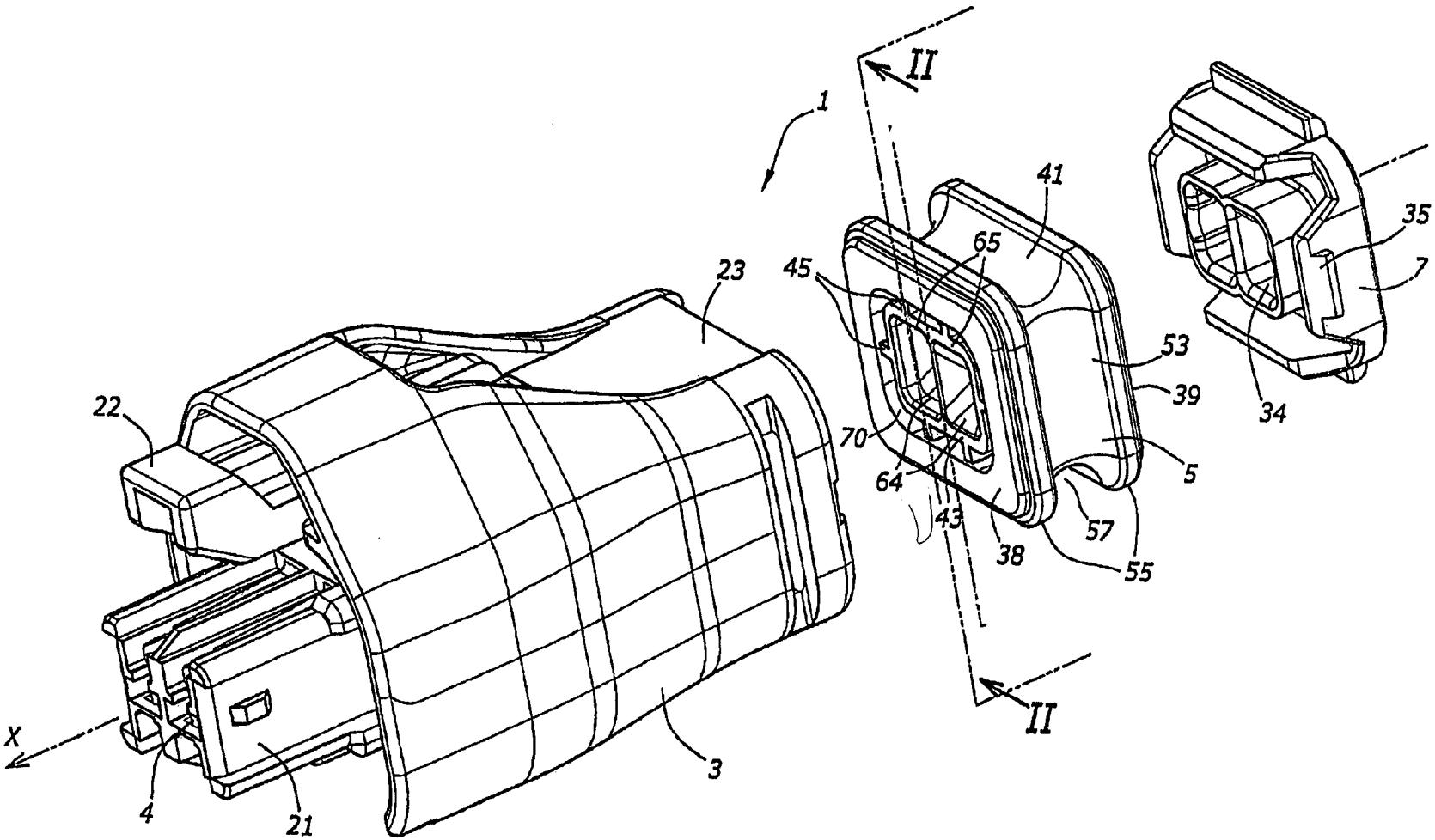
FIG. 1 is a partial exploded perspective view of a two-way electrical connector provided with a grommet joint of the invention.
Figure 1:
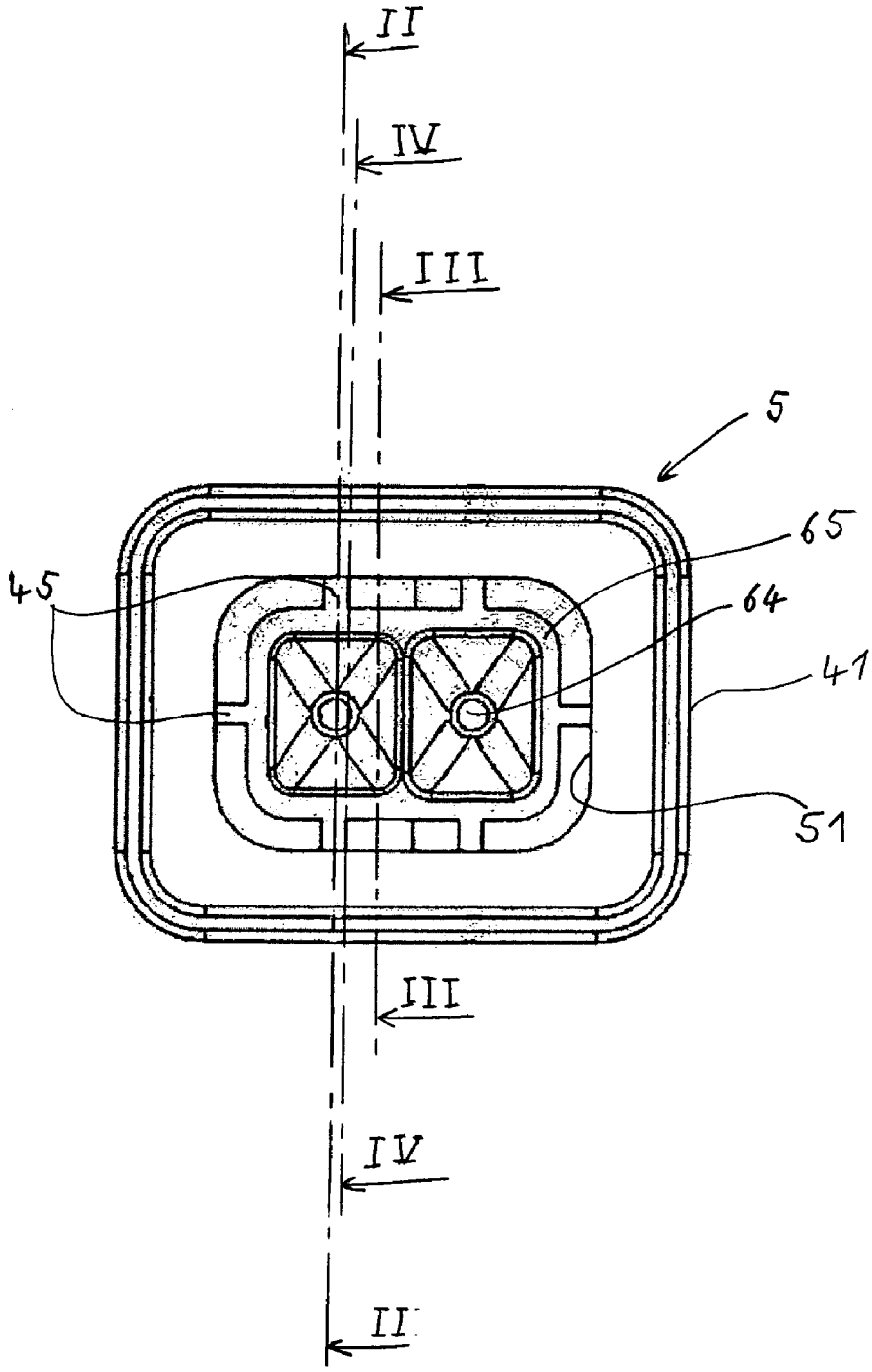

A connector comprising a grommet-type joint (hereafter "grommet") according to the invention is illustrated on FIGS. 1-4. This connector is of a type used in an automotive application, and is intended to mate with a counterpart connector (not shown).

On FIGS. 1-4, the mating direction is referenced as X axis, which is oriented from the connector towards the counterpart.

The orientation or position terms used in the present description refer to this mating axis X. In particular, the terms "forward" or "front" read as oriented in the mating direction.

The two-way connector 1 shown on FIGS. 1-4 comprises an insulating housing 3, wherein two terminal accommodating chambers 4 are formed, a grommet 5, and a rear grid 7.

The connector 1 also comprises two terminals 9 crimped at the end of respective wires 10, and, in use, fixedly arranged in respective accommodating chambers 4 of the housing 3.

Figure 2:
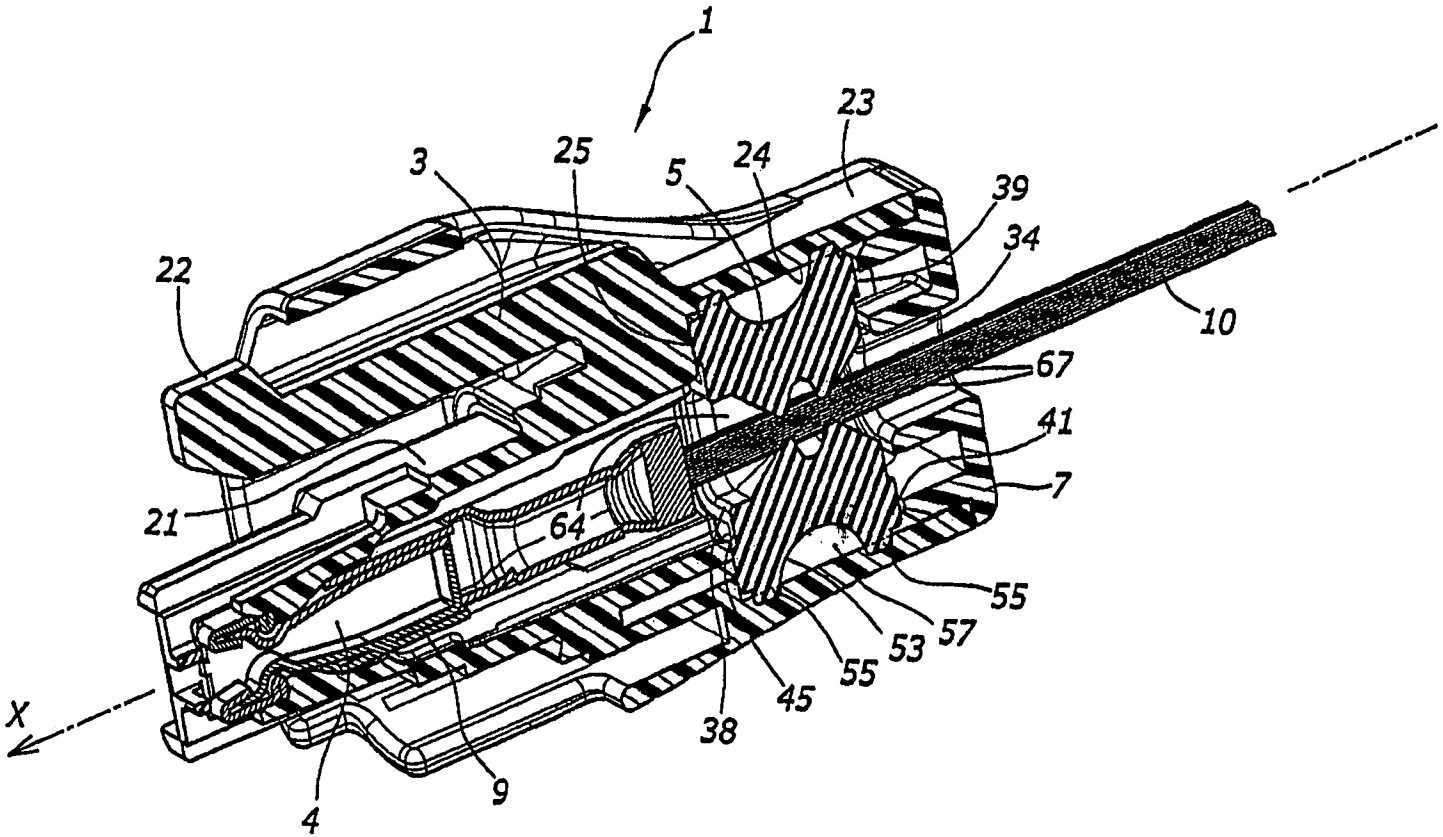
FIG. 2 is a cross-sectional perspective view of the connector shown on FIG. 1, in the axial median plane II of one terminal accommodating chamber, a terminal and a corresponding cable section being shown in use position.
Figure 3:
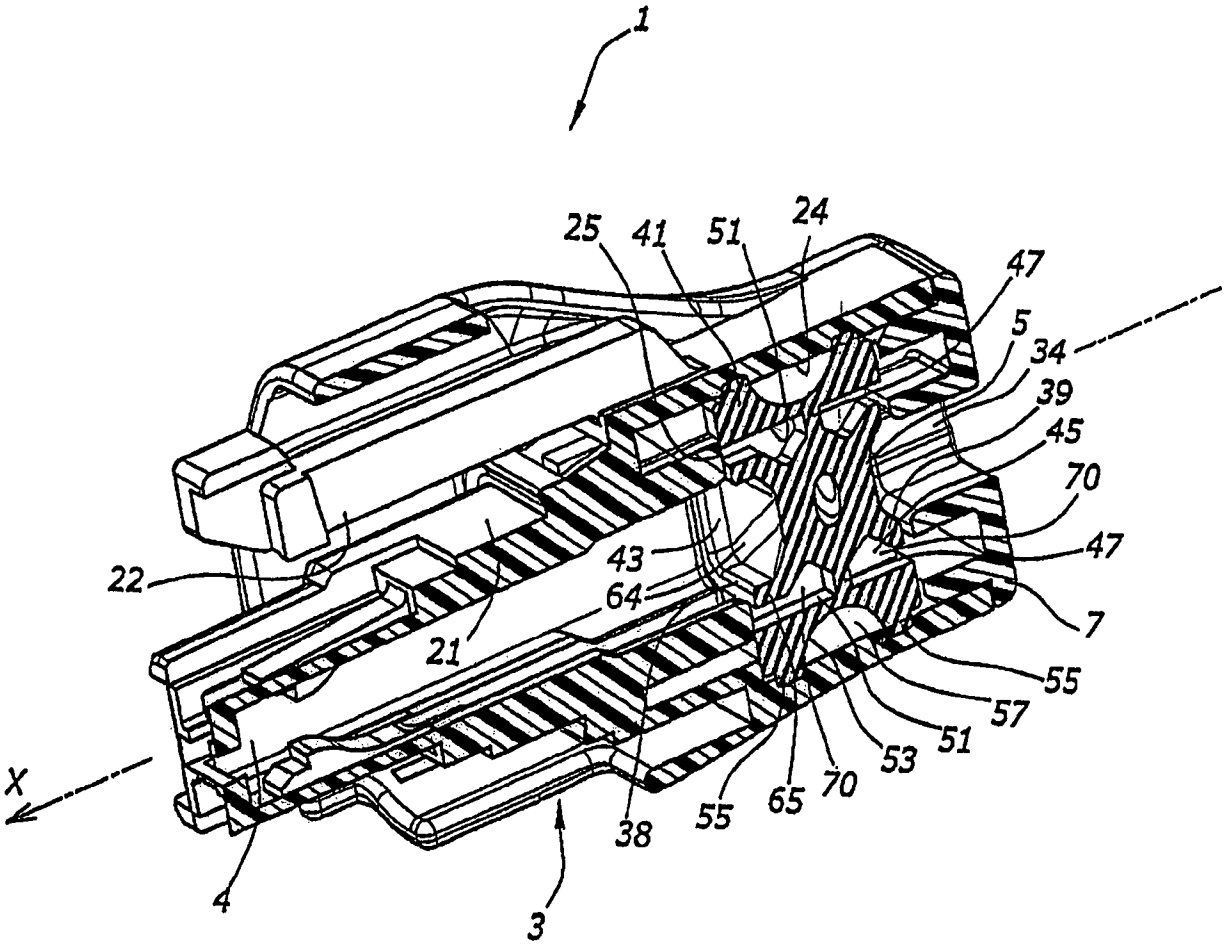
FIG. 3 is a cross-sectional perspective view of the connector shown on FIG. 1, in an axial plane III that is approximately half way between the plane II and the median plane of connector.
Figure 4:
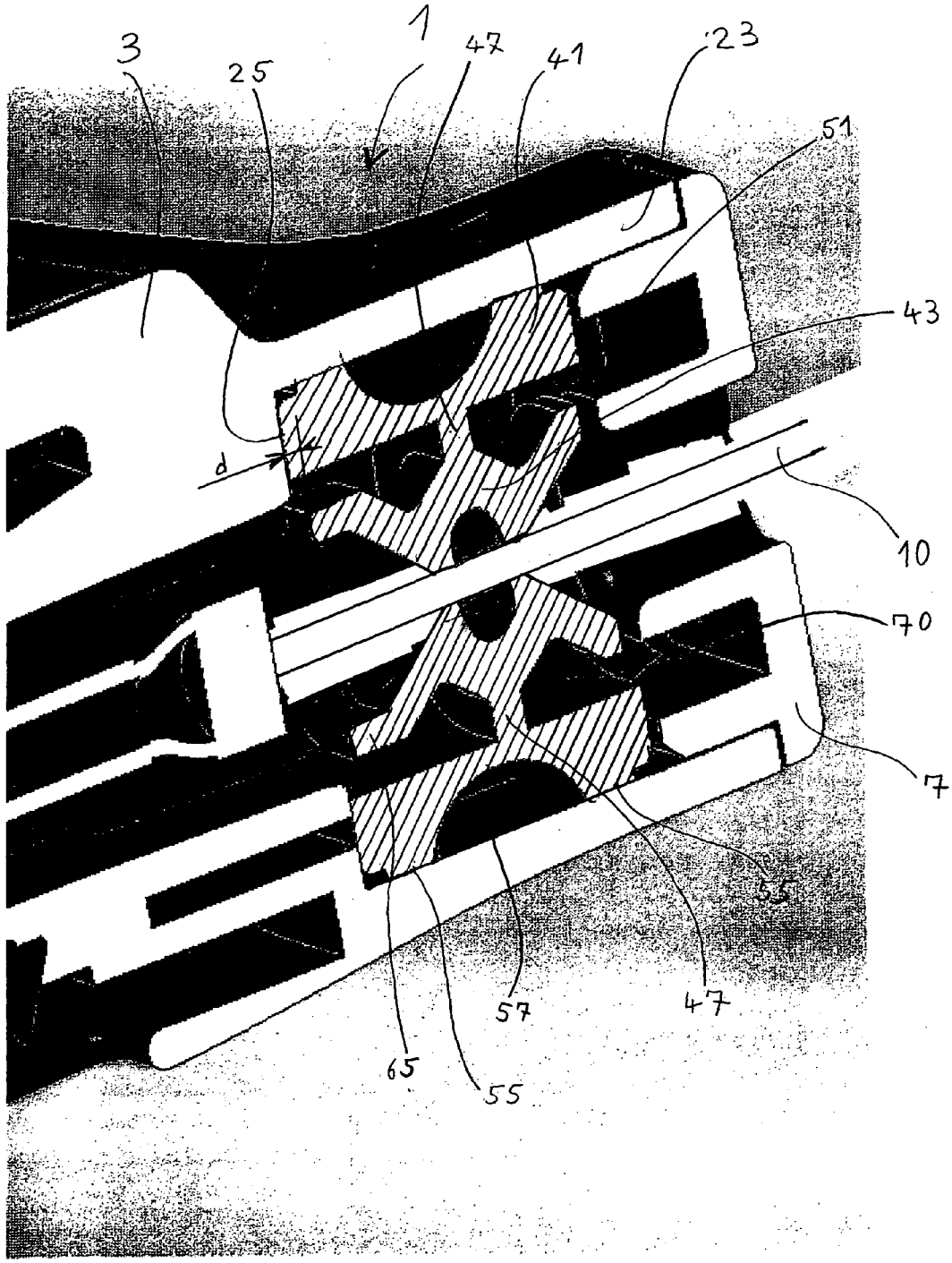
FIG. 4 is a cross-sectional perspective view of the connector shown on FIG. 1, in an axial plane IV that is slightly offset from the median plane II such a way it does not cut a flexible wall.

Only one of said terminals is shown on FIGS. 2 and 4, the terminals being not shown on FIGS. 1 and 3.

The housing 3 has a generally parallelepipedic front part 21, wherein the accommodating chambers 4 are formed as through passages, a locking member 22 provided to engage a complementary locking member of the counterpart connector, and a rear skirt 23.

Said rear skirt 23 mainly consists in a peripheral outer wall, which is generally parallelepiped-shaped and which projects rearwards from the rear end of the front part 21. The skirt 23 defines an inner recess, opened at the rear end, for accommodating the grommet 5 and the grid 7. The inner surface 24 of the skirt 23 is provided to be sealingly engaged by the outer peripheral surface of the grommet.

As shown on FIG. 2, the housing 3 has an inner annular shoulder 25 at the front end of the skirt, which defines a front axial abutment for the grommet 5.

The housing 3 is preferably integrally made of a plastic material.

The grid 7 is also preferably integrally made of a plastic material, and is essentially made as a cover having two through axial passages 34 corresponding to the chambers 4. The grid 7 also has locking means 35 provided to fasten the grid in the skirt 23 in its use position (see FIG. 1).

The grommet 5 is overall parallelepiped-shaped, and has a front face 38 and a rear face 39. It essentially comprises a peripheral annular portion 41, a central portion 43, and flexible means 45, 47 connecting said central portion 43 to said peripheral portion 41.

The grommet is preferably of unitary construction and made by moulding of a resilient elastomeric material.

The peripheral annular portion 41 has an inner parallelepiped-shaped surface 51, and an outer surface 53. The outer surface 53 is formed with two axially spaced annular lips 55, which, in use, sealingly engage the inner surface 25 of the skirt 23. The lips 55 are axially separated by an annular grove 57, semi-circular in section, which is formed in the outer surface 53.

The central portion 43 is also generally parallelepiped-shaped, and is formed with two axial through passages 64, corresponding to the respective passages 34 and accommodating chambers 4.

Each of said passages 64 is defined by a respective sleeve 65, both sleeves constituting together the central portion 43.

Each sleeve 65 is provided with two annular axially spaced-apart lips 67, projecting in the passage 64 to define narrow sections and, in use, sealingly engage the corresponding wire 10.

The flexible means 45, 47 extend between the outer peripheral surface of the central portion 43 and the inner surface 24 of the peripheral portion 41.

Preferentially flexible means include first walls 45 that extend in axial planes, i.e. planes parallel to axis X, and each sleeve 65 being connected to the peripheral portion 41 by at least one such axial wall 45. In the example shown on FIG. 1-4, walls 45 are perpendicular to the inner surface 51 of annular portion 41 and for each sleeve 65, there is one wall starting from a median line of each of the sides which are facing the inner surface 51. This means that the planes defined by each wall 45 that is attaching one sleeve are going through the axis of the corresponding sleeve. Each sleeve 65 is connected to the peripheral portion 41 by at least a pair of coplanar opposite axial walls, which are coplanar with or centered on the respective passage axis, and a supplementary wall in a direction perpendicular to the first coplanar walls for the sleeves located at the two extremities of the central portion 43. This position of the walls 45 allows an easy deformation of the sleeves 65 along their diagonals which corresponds to the diagonals of the terminals, what allows those terminals to go easily through the grommet.

The flexible walls also comprise one annular radial wall 47 which extends in a mid-section of the grommet 5, in other words at half-length of the central portion 43. The grommet 5 is substantially symmetrical with respect to the radial plane of the annular wall 47.

The grommet 5 is thus provided with recesses 70 defined by the flexible walls 45, 47 between the peripheral portion 41 and the central portion 43. These recesses 70 extend from the radial wall 47 to either the front face 38 or the rear face 39, and are opened on either said front or rear face.

The radial wall 47 constitutes a sealing wall which prevents water passage from the rear side 39 to the front side 38 of the grommet.

The recesses 70 are blind hollow spaces in which the elastomeric material of the central portion can expand upon insertion of the terminals in the corresponding passages 64.

In section, the walls 45, 47 have a much lower thickness than the recesses, whereby they provide a highly flexible connection between the central portion 43 and the peripheral portion 41.

The central portion 43 is floatably and rotatory (as a ball and socket joint) attached to the peripheral portion 41, which means that the central portion 43 is laterally or transversally displaceable with respect to the peripheral portion 41, and can also slightly rotate with respect to transversal axis to compensate misalignment and minimize the insertion force. The central portion 43 is biased toward a neutral position centred within the peripheral portion 41.

Preferentially the sleeves 65 are in the X direction slightly shorter than the peripheral portion 41. Such a way that when the peripheral portion 41 is in abutment against shoulder 25 there is a small clearance d in the X direction between the central portion 43 and the bottom portion of the said inner recess defined by the skirt 23. This allows the central portion 43 to move easily along the X axis or to rotate freely without coming into contact with the housing 3. A similar feature is built at the other side between the grommet and the grid 7. In another embodiment a similar result could be obtained by having a small recess in the housing in front of the central portion 43.

Figure 5:
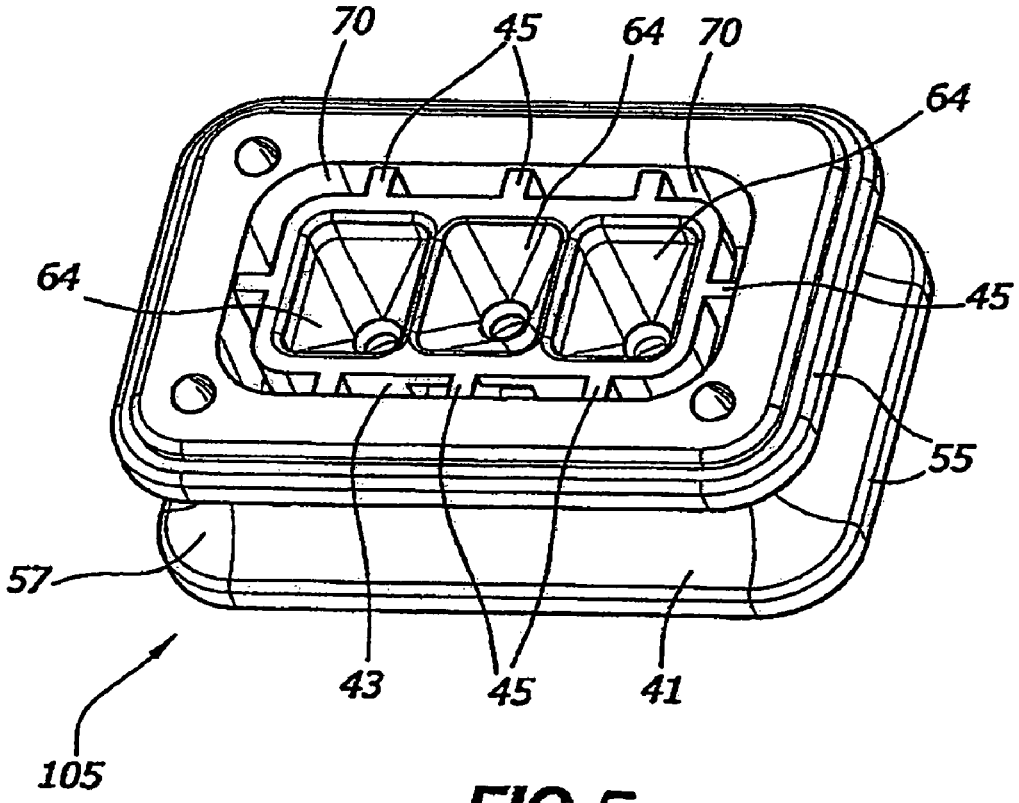
FIG. 5 is a perspective view of a three-way grommet of the invention.

FIG. 5 shows another example of grommet 105 according to the invention, which only differs from the grommet of FIG. 1-3 in that it is suitable for three-way connectors.

It is thus provided with three passages 64 arranged in one row in the central portion 43. The central sleeve 65 defining the central passage 64 in attached to the peripheral portion 41 by only two coplanar axial walls 45, whereas the lateral sleeves at the end of the rows are attached by three axial walls.

However, the flexible axial walls 45 are symmetrically and regularly arranged on the central portion circumference, as it was the case in the preceding example.

Figure 6:
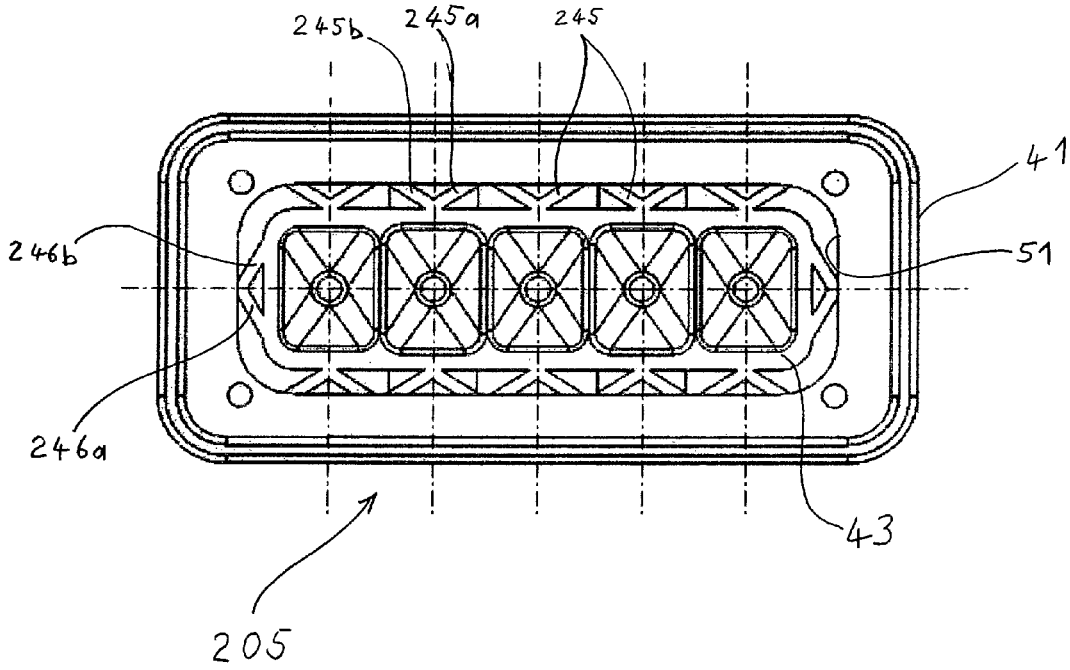
FIG. 6 is a front view of another embodiment of a grommet of the invention.

FIG. 6 shows another embodiment of a grommet 205 according to the invention for connectors with five terminals. The peripheral portion 41 and the central portion 43 are similar to the corresponding portions of the preceding embodiments. The flexible means connecting the central portion 43 to the peripheral portion 41 include walls 245 which are at an angle to the inner surface 51 of annular portion 41. Preferentially for each sleeve 65, there are two walls starting from a median line of each of the sides which are facing the inner surface 51, a first wall 245*a* starting in a first direction and a second wall 245*b* in a second direction symmetrical to the first one about an axial plane of the sleeve 65. Alternatively, an example being represented on FIG. 6 by the flexible connecting means 246*a*, 246*b* at one small side of the inner surface 51, the two walls can start from the same point at the surface 51 and connect on the sleeve at two separate lines. In this embodiment, when the cable is moving inside the sleeve, the movement being either a translation perpendicular to axis X or a rotation around the centre of the sleeve, the walls are mainly deformed by bending and not by stretching or compression as in the preceding embodiments, which means a reduced stiffness. The stiffness in translation and rotation can also be adjusted by the choice of angle and thickness of the walls.

Of course, the invention would also be suitable for grommets having different numbers of passages for wires, and more generally would be also suitable for one- or multi-way grommets and connectors, wherein the ways are arranged in one or several rows.

The invention claimed is:

1. A grommet-type joint for an electrical connector, comprising:

a peripheral portion having a peripheral outer surface provided to sealingly engage a peripheral inner surface of a connector housing, and a central portion having a plurality of through passages for wires, said passages extending in an axial direction (X) and adapted to sealingly engage said wires, wherein recesses are provided between said central portion and said peripheral portion, said central portion being attached to said peripheral portion by flexible means, wherein said flexible means comprise axial walls, each extending between an inner surface of the peripheral portion and an outer surface of the central portion, wherein each of the passages is formed in a respective sleeve of the central portion, and each respective sleeve is attached to the peripheral portion by a separate one of said flexible axial walls, wherein each sleeve is attached to the peripheral portion by at least a pair of coplanar opposite ones of said axial walls, said pair of walls being coplanar with the axis (X) of the respective passage.

2. The grommet-type joint as claimed in claim 1, wherein said flexible means comprise a radial annular wall, which extends between an inner surface of the peripheral portion and an outer surface of the central portion.

3. The grommet-type joint as claimed in claim 2, wherein said annular wall is provided in a radial plane substantially at half-length of the central portion.

4. The grommet-type joint as claimed in claim 1, wherein said joint has opposed front and rear sides, and said recesses are blind and opened on either front side or rear side.

5. The grommet-type joint as claimed in claim 1, wherein said central portion is parallelepipedic.

6. The grommet-type joint as claimed in claim 1, wherein said joint is provided with only one row of passages.

7. The grommet-type joint as claimed in claim 1, wherein said joint is moulded as a unitary construction.

8. An electrical connector comprising an insulating housing, and a grommet-type joint as claimed in claim 1, which is arranged in said housing.

9. The electrical connector according to claim 8 wherein no part of the housing extends in any recess.

10. The electrical connector according to claim 8 wherein the housing comprises a shoulder defining an inner recess, wherein the peripheral portion is in abutment on said shoulder, and wherein there is a clearance between the central portion of the joint and a bottom portion of said inner recess.

11. An electrical connector according to claim 8, wherein the housing comprises:

a generally parallelepiped front part;

a rear skirt consisting in a peripheral outer wall generally parallelepiped-shaped, projecting rearwards from the front part, defining an inner recess for accommodating the grommet-type joint and a grid, and having an inner surface to be engaged by the outer surface of the peripheral surface; and an inner shoulder which defines a front axial abutment for the grommet-type joint, wherein the recesses are blind hollow spaces in which the material of the central portion can expand.

12. The grommet-type joint as claimed in claim 1, wherein the central portion is rotatory attached to the peripheral portion.

13. The grommet-type joint as claimed in claim 1, wherein a sleeve of a first one of the passages is directly connected to a sleeve of a second one of the passages.

14. An electrical connector grommet comprising:

a peripheral portion having a peripheral outer surface adapted to sealingly engage a peripheral inner surface of a connector housing, and a central portion having a plurality of through passages for wires, the passages extending in an axial direction, wherein recesses are provided between the central portion and the peripheral portion, wherein the central portion is attached to the peripheral portion by axial walls, wherein each axial wall extends between an inner surface of the peripheral portion and an outer surface of the central portion, wherein each passage is formed in a respective sleeve of the central portion, and wherein each respective sleeve is attached to the peripheral portion by a separate pair of coplanar opposite ones of the axial walls.

15. An electrical connector grommet as claimed in claim 14, wherein a sleeve of a first one of the passages is directly connected to a sleeve of a second one of the passages.

* * * * *